US006604755B2

(12) United States Patent
Ayliffe et al.

(10) Patent No.: US 6,604,755 B2
(45) Date of Patent: Aug. 12, 2003

(54) APPARATUS FOR AFFIXING CLIMBING SKINS TO SKIS

(75) Inventors: Harold Edward Ayliffe, North Vancouver (CA); Tian Gee, West Vancouver (CA)

(73) Assignee: G3 Genuine Guide Gear, Inc., North Vancouver (CA)

( * ) Notice: Subject to any disclaimer, the term of this patent is extended or adjusted under 35 U.S.C. 154(b) by 139 days.

(21) Appl. No.: 09/770,855

(22) Filed: Jan. 26, 2001

(65) Prior Publication Data

US 2002/0101071 A1 Aug. 1, 2002

(51) Int. Cl.[7] ..... A63C 7/04
(52) U.S. Cl. ..... 280/604; 280/809
(58) Field of Search ..... 280/809, 604, 280/605, 608, 609, 615, 816; 24/265 R, 265 EC

(56) References Cited

U.S. PATENT DOCUMENTS

| | | | | | |
|---|---|---|---|---|---|
| 2,189,760 | A | * | 2/1940 | Matthee et al. | 280/604 |
| 4,095,813 | A | * | 6/1978 | Hall | 280/604 |
| 4,544,179 | A | * | 10/1985 | Boudreau | 188/8 |
| 4,666,178 | A | * | 5/1987 | Matthews | 280/604 |
| 5,052,708 | A | * | 10/1991 | Matthews | 280/604 |
| 5,649,722 | A | * | 7/1997 | Champlin | 280/14.22 |
| 6,105,990 | A | * | 8/2000 | Sutherland | 280/604 |
| 6,471,234 | B2 | * | 10/2002 | Ayliffe | 280/604 |

FOREIGN PATENT DOCUMENTS

| | | | | |
|---|---|---|---|---|
| AT | 137508 | * | 12/1933 | 280/604 |
| AT | 148191 | * | 8/1936 | 280/604 |
| AT | 163089 | * | 10/1948 | 280/604 |
| CH | 50972 | * | 2/1910 | 280/604 |
| CH | 62154 | * | 7/1913 | 280/604 |
| CH | 84074 | * | 2/1920 | 280/604 |
| CH | 208763 | * | 5/1940 | 280/604 |
| CH | 223797 | * | 4/1943 | 280/604 |
| CH | 250092 | * | 5/1948 | 280/604 |
| CH | 314947 | * | 8/1956 | 280/604 |
| DE | 924496 | * | 3/1955 | 280/604 |
| DE | 1 926 315 | * | 1/1970 | 280/604 |
| DE | 33 18259 A1 | * | 11/1994 | 280/604 |
| FR | 736902 | * | 5/1932 | 280/604 |
| FR | 1 334 734 | * | 7/1963 | 280/604 |
| GB | 487201 | * | 6/1938 | 280/604 |
| IT | 373708 | * | 8/1939 | 280/604 |
| NO | 65863 | * | 3/1943 | 280/604 |

OTHER PUBLICATIONS

Mountain Equipment CO–OP Catalogue Fall •Winter 2001 (Vancouver Canada) p. 16—plus enlargement of p. 16—Published Fall of 2000.

Mountain Equipment CO–OP Catalogue Fall • Winter 1999 (Vancouver Canada) p. 22—plus enlargement of p. 22—Published Fall of 1998.

Declaration/Affidavit (Original document)—includes 2 attached Exhibits marked Exhibit 1 and Exhibit 2. Signed Nov. 23, 2001 by Inventor Ayliffe, H.E. and Jan. 11, 2002 by Inventor Gee, T.

* cited by examiner

*Primary Examiner*—Brian L. Johnson
*Assistant Examiner*—Bridget Avery

(57) ABSTRACT

A retention system for retaining a climbing skin to the tail end of a ski comprises an elongated resilient tensioning member secured to one end of the skin, a generally C-shaped clip adapted to removably hook about the tail end, and means on an upper portion of said clip for releasably retaining a portion of said tensioning member thereon. In the preferred embodiment the upper portion of the clip includes an aperture for receiving the tensioning member therethrough and a projection for engaging in one of several eyelets provided on the tensioning member.

20 Claims, 6 Drawing Sheets

APPARATUS FOR AFFIXING CLIMBING SKINS TO SKIS

FIELD OF THE INVENTION

This invention relates to a system for securing a climbing skin to the bottom of a ski. In particular, the invention relates to a system for securing a climbing skin to one end of the ski, particularly the tail end of the ski, for tensioning a climbing skin.

BACKGROUND OF THE INVENTION

Climbing skins have been used on skis for many, many years to assist skiers in ascending slopes. Original climbing skins were made from the skins of animals. More recently, climbing skins have been made from synthetic fabrics which have a nap of stiff, rearwardly angled fibers projecting from their bottom surfaces. When the skins are attached to the skis, the skis can be slid in a forward direction relatively easily. When the skis are moved in a rearward direction then the fibers bite into the snow. By attaching climbing skins to both skis, a skier can up even a reasonably steep snow slope by sliding one ski forward and then the other.

Attaching a climbing skin securely to the bottom of a ski in such a way that the climbing skin will not be easily dislodged during use and snow will not build up between the base of the ski and the climbing skin can be difficult. The problem of securely attaching climbing skins to skis is exacerbated by the fact that a skier my repeatedly put climbing skins onto skis and take them off during the course of a days skiing.

Early climbing skins simply had straps which were used to attach the climbing skin to the ski. Typically straps were provided to stretch the climbing skin between the tip and tail of the ski and additional straps were provided along the edges of the climbing skin. The additional straps could be used to tie the climbing skin to the ski itself. Such climbing skins tended not to work very well because it is generally not possible to tie the skin to a ski tightly enough to prevent snow from building up underneath the climbing skin. Furthermore, the numerous straps were time consuming to attach and keep properly adjusted.

More recently, adhesive climbing skins have been developed. Some adhesive climbing skins have a hook or the like which hooks over the tip of the ski. The skin is simply pressed against the ski base and is detachably held in place by a tacky adhesive. Such climbing skins provided acceptable performance when the base of the ski was dry. However, if the adhesive on the climbing skins becomes covered with snow or if the base of the ski becomes wet and has snow adhering to it then the adhesive may not properly hold the climbing skin to the base of the ski. In such cases, the climbing skin can become unstuck from the ski especially at the tail.

Climbing skins which use an adhesive as well as tail and tip straps to hold it in place have also become popular. This common tail fixation method is problematic in that it is usually necessary to modify the ski to provide a way to attach a strap to the tail end of the ski. Some current climbing skin systems have a fixture, such as a pin which is screwed into the top surface of the ski near the tail. A strap from the rear end of a climbing skin can then be stretched around the tail of the ski and attached to the pin. This is not desirable because it requires modification of the ski itself.

In another common tail fixation method, the skin is riveted to a pair of sandwiching metal plates that include an integral hook for engaging the tail end of the ski. Because the metal hook is relatively rigid, the strap must be moved to the tip end of the ski. Two rectangular metal wire looks (clips) are typically connected by a short (about 4 inches long) elastic, rubbery strip. The skin is fed through a portion of one of these separate clips and is looped back to adhere onto itself. The clip on the other end of the elastic strip is hooked over the tip of the ski to hold the skin in place. Having the elastic strip located at the tip can be a problem when the skier accidentally hits the wire loop with the opposite ski thereby knocking the clip completely off the tip of the ski. Once the skin is free from the tip of the ski, it can drag through the snow and the skin adhesive can become contaminated and eventually fail.

There is a need for an attachment system for climbing skins which allows climbing skins to be securely affixed by straps at both tip and tail ends of the ski and yet which is easy to use and does not require modification of the ski itself.

SUMMARY OF THE INVENTION

In one of its aspects, the present invention comprises a retention system for retaining a climbing skin to the tail end of a ski. The system includes an elongated resilient tensioning member, such as a strap, secured to one end of the skin. A separate, generally C-shaped clip is provided. The clip is adapted to removably hook about the tail end of the ski. Means are provided on an upper portion of the clip for releasably retaining and tensioning a portion of the strap on the clip. The clip provides a securement point for the strap and skin combination and is held by the tensioning effect of the strap. The arrangement is easily field serviceable and no permanent modification to the ski is required.

In another aspect of the invention, the clip has a flat base portion adapted to underlie the tail end of the ski, a vertical section adapted to extend behind the tail end, an angled portion extending from the vertical section at an acute angle in relation to the base portion and an upper portion extending from the angled portion and adapted to extend over the tail end. The upper portion includes an aperture sized to receive one end of the tensioning member therethrough.

In another aspect of the invention, there are provided a plurality of eyelets longitudinally spaced on the tensioning member, and a projection on the upper portion. The projection is sized to fit within the eyelets to retain the tensioning member on the clip. In a particular aspect of the invention, the upper portion comprises a portion having a generally apical shape having at least one downwardly extending leg and the aperture is located in the downwardly extending leg.

In yet another aspect, the invention comprises the method of attaching a climbing skin to the tail end of a ski, comprising providing a climbing skin attached to one end of a resilient tensioning member, hooking a generally C-shaped clip about said tail end of said ski such that a base portion of said clip underlies said tail end of said ski and an upper portion of said clip extends over said tail end of said ski and releasably securing a portion of said tensioning member to said upper portion of said clip so as to tension said clip in engagement about said tail end of said ski.

In a more particular aspect of the invention, the step of releasably securing the tensioning member to the upper portion of the clip involves threading that portion of the tensioning member through an aperture in the upper portion of the clip and engaging a projection on the upper portion into one of a plurality of eyelets longitudinally spaced on the tensioning member.

In yet a further aspect, the invention comprises a kit for a retention system for retaining a climbing skin on the tail end of a ski, comprising an elongated resilient tensioning member secured to one end of the skin, a generally C-shaped clip adapted to hook about said tail end, said clip having a flat base portion adapted to underlie said tail end, an angled portion extending at an acute angle in relation to the base portion and an upper portion extending from said angled portion and adapted to extend over the tail end, the upper portion being adapted to releasably retain one end of the member.

Other aspects of the invention will be appreciated by reference to the detailed description and to the claims.

BRIEF DESCRIPTION OF THE DRAWINGS

In drawings which illustrate various non-limiting embodiments of the invention.

DETAILED DESCRIPTION OF THE PREFERRED EMBODIMENT

Figure 1:
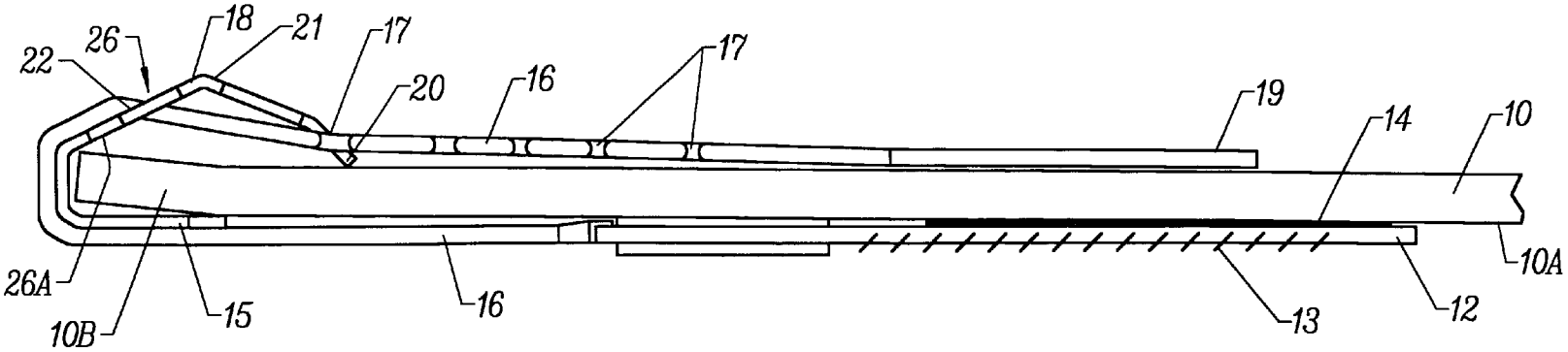
FIG. 1 is a section through a climbing skin mounting system on the rear of a ski.
Figure 2:
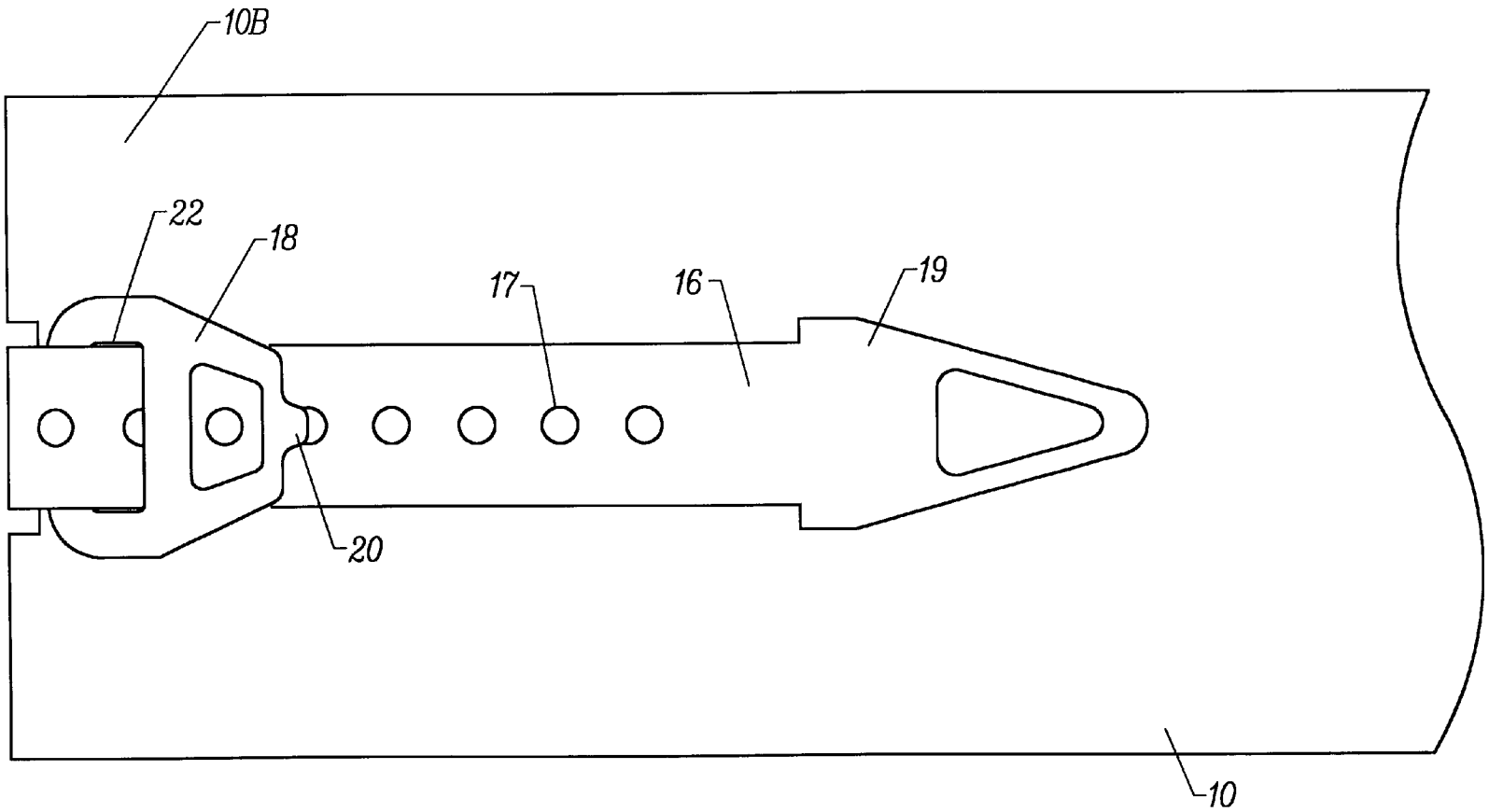
FIG. 2 is a top view thereof.

FIGS. 1 and 2 show a ski 10 to which is attached a climbing skin 12. Elongated climbing skin 12 has a nap 13 made of rearwardly angled bristles and is attached to the base 10A of ski 10 with a suitable removable adhesive 14. An elongated tensioning strap 16 is affixed to the rear end of skin 12 as discussed in greater detail below. Strap 16 is affixed at the tail 10B of ski 10 with a mounting clip 18.

Mounting clip 18 is very generally C-shaped in cross-section and hooks around the tail 10B of ski 10. Clip 18 has a low rigid flat portion 15 which extends underneath the base 10A of ski 10. Clip 18 is rigid so that it can slide onto tail 10B of ski 10 but cannot rotate when it is on ski 10. Clip 18 may be made from any suitable material such as steel or a rigid plastic. Strap 16 has a number of longitudinally spaced apertures 17 in its distal portions. A user can apply tension to strap 16, pull strap 16 around the rear end of clip 18 and then hold strap 16 in place on clip 18 by hooking one of apertures 17 around a projecting pin 20 on clip 18.

In the preferred embodiment shown in FIG. 1, clip 18 has a raised portion 21 in which is an aperture 22. Strap 16 passes through aperture 22. Thus, clip 18 remains on strap 16 even when skin 12 and strap 16 are removed from the ski 10. The shape of clip 18 tends to prevent clip 18 from rotating relative to tail 10B of ski 10 under the tension forces exerted on strap 16. The strap 16 exerts a net forward pulling force on clip 18, i.e. it exerts a net force inward from the tail end 10B of the ski. This net force acts to retain clip 18 in engagement about the tail end of the ski.

Preferably the rear portion 26 of clip 18 has a short vertical surface adapted to extend upward behind the tail end of the ski, and a surface 26A extending from the top of the vertical surface and which is disposed at an acute angle relative to base portion 15. Thus, when clip 18 is installed and strap 16 is under tension, the tail end 10B of ski 10 is wedged into the rear end of clip 18 between surface 26A and lower portion 15 of clip 18. This tends to prevent clip 18 from sliding sideways in either direction on the tail 10B of ski 10.

Unintentional rotation of the clip 18 about the tail end 10B of the ski is prevented by the bracing effect of the base portion 15 of the clip 18 that underlies the ski and by the angled surface 26A abutting against the corner of the tail end. It will be appreciated that the length of the base portion 15 and the angle of the surface 26A can be chosen to nonetheless allow intentional removal of the clip by the user pulling the strap rearward of the ski.

Preferably strap 16 and/or skin 12 are slightly resilient so that skin 12 and strap 16 remain under tension while in use. Strap 16 may be made from a strip of fabric-reinforced rubber, or the like. Most preferably, the rearmost end 19 of strap 16 is broadened. This both prevents the accidental removal of clip 18 from strap 16 and provides a convenient hand grip for applying tension to strap 16 when attaching skin 12 to a ski.

Figure 3:
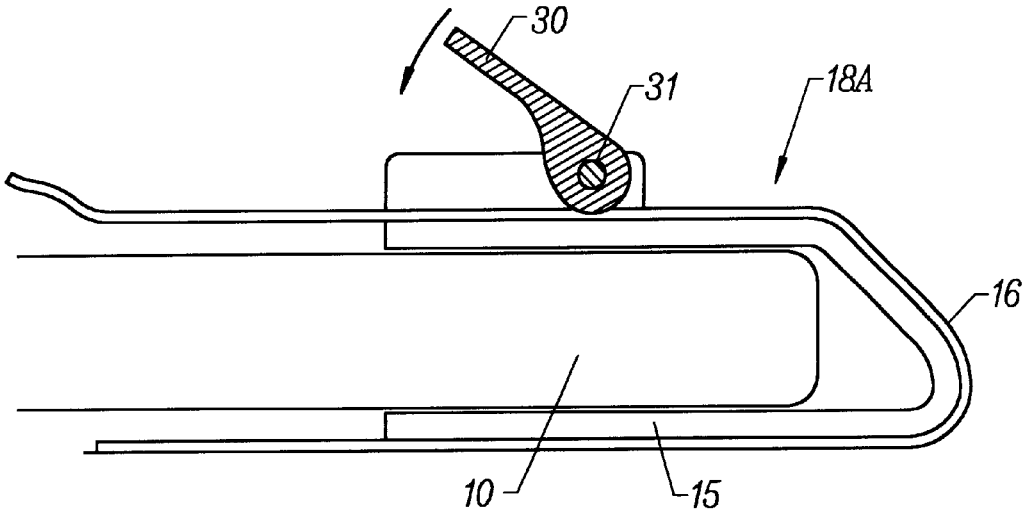
FIG. 3 is a section through an alternative embodiment of a clip which includes a jam nut.

In the embodiment shown in FIGS. 1 and 2, the strap 16 is releasably affixed to clip 18 by means of a pin 20 on clip 18 which is received through an aperture 17 in strap 16. Other suitable means for holding the strap 16 is a tensioned manner to clip 18 may also be used. For example, as shown in FIG. 3, clip 18A may include a jam lever 30 which can be pressed down so as to hold strap 16 in place on clip 18 by compressing a strap between a cam 31 and a surface 32 on clip 18A. Jam levers are known in the art and can be readily purchased from various sources. Preferably the jam lever 30 is installed so that tension on strap 16 tends to tighten the cam, and thereby prevent strap 16 from becoming loose during use.

Figure 4:
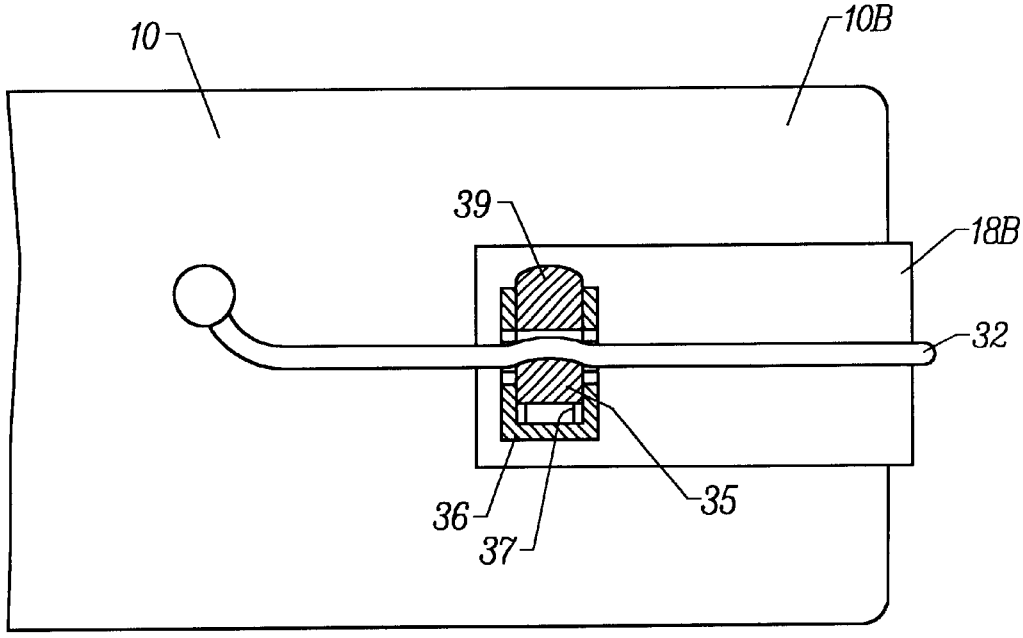
FIG. 4 is a partially sectioned top plan view of a clip according to an alternative embodiment of the invention in which a cord lock device holds a cord under tension.

As shown in FIG. 4, strap 16 could comprise a cord instead of a flat strap or could comprise a flexible flat member having a cord attached to its end. In the embodiment of FIG. 4, a cord 32 attached to a climbing skin passes around the rear end of clip 18B to be held in place on clip 18B by a cord lock device 34. Cord lock devices 34 of various types are well known in the art. The type of cord lock device shown in FIG. 4 has a plug 35 slidably mounted within a housing 36. Plug 35 is biased toward one side of the housing 36 by a spring 37. Cord 32 passes through apertures 38 in the housing and the plug and is jammed between the plug and the housing. A release button 39 allows a user to displace the plug 35 against the bias force exerted by the spring 37 to release the cord 32. Cord lock device 34 is preferably of a type which is designed in such a manner that tension on cord 32 tends to tighten the cord lock device 34.

Figure 5:
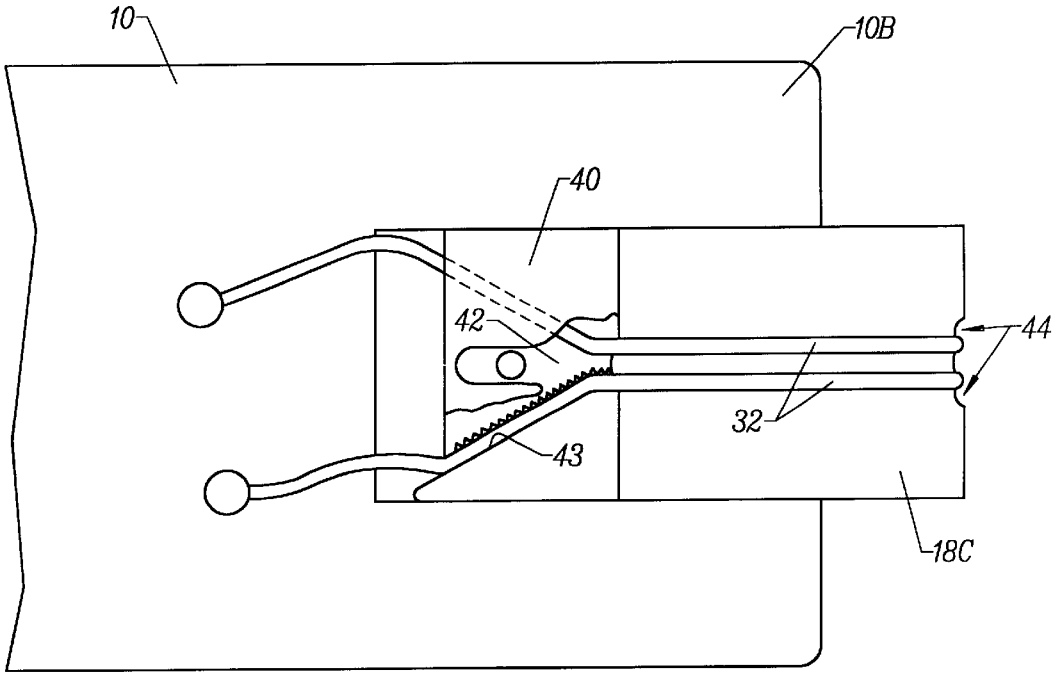
FIG. 5 is a schematic, partially cut-away top view of a mounting system according to an alternative embodiment of the invention which has a pair of cords held in a dual-cord cord lock.

FIG. 5 shows a clip 18C in which a skin 12 is tensioned on a ski 10 with a dual-cord cord lock 40. Cords 32 pass between a wedge 42 and inclined walls 43. Tension on cords 32 tends to pull wedge 43 rearwardly, thereby tightly gripping cords 32. The angles of walls 43 relative to the longitudinal center of clip 18C are exaggerated in FIG. 5. In the FIG. 5 embodiment cords 32 pass around locating grooves in the rear end of clip 18C. Locating grooves 44 guide cords 32.

Figure 6:
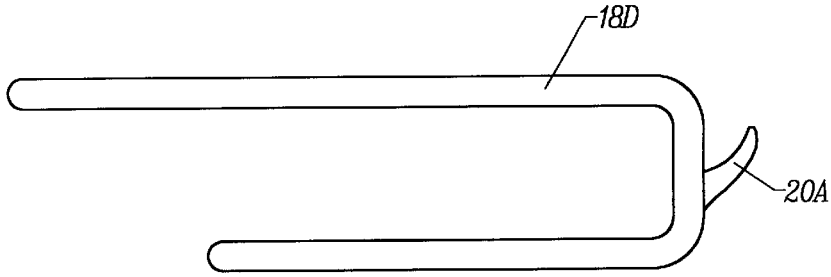
FIG. 6 is a side elevation of a clip having a pin projecting from a location on its rear side.

When a strap is affixed to a clip 16 by a way of a tab which projects through a hole in the strap, it is not necessary that the tab be located in the same position shown in FIGS. 1 and 2. FIG. 6 shows a clip 18D according to an alternative embodiment wherein a tab 20A projects generally rearwardly from clip 18. This embodiment is not preferable because of the enhanced likelihood that strap 16 may become accidentally dislodged from tab 20A in the FIG. 6 embodiment during use.

Figure 7:
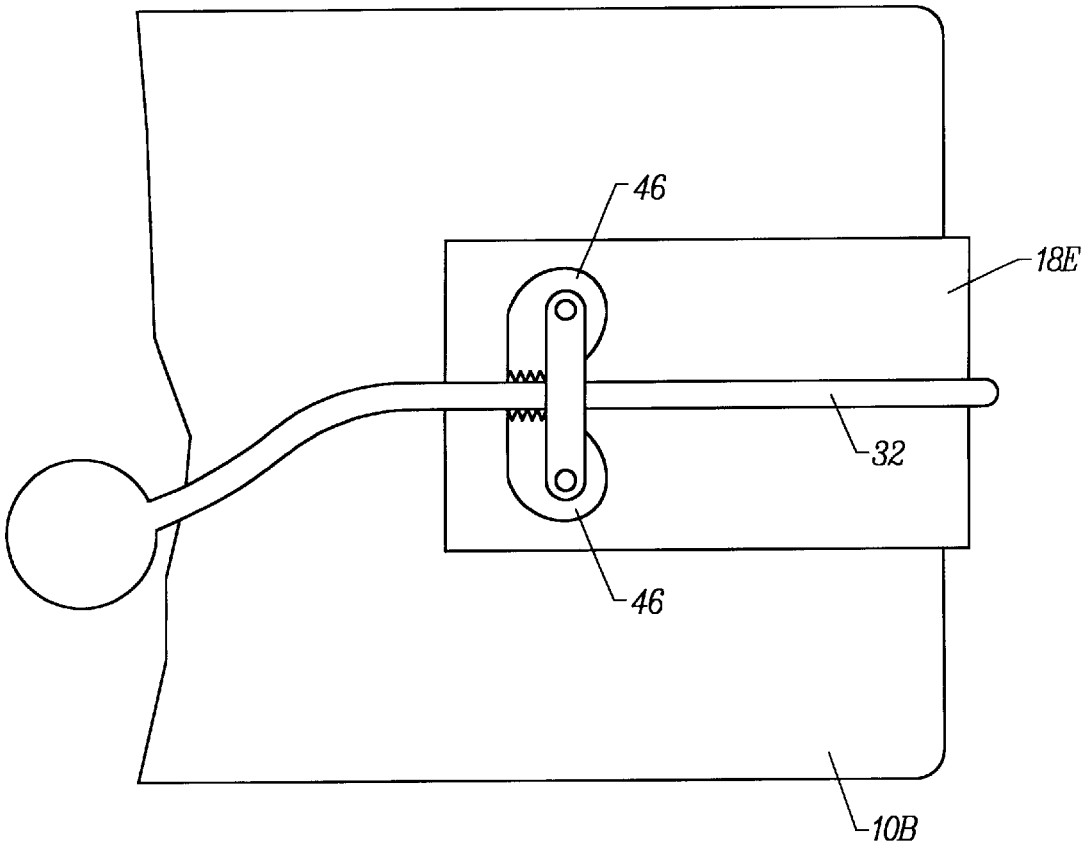
FIG. 7 is a top view of a further alternative embodiment of the invention wherein a cord is held between a pair of spring-loaded cams.

FIG. 7 shows a further alternative embodiment wherein a cord 32 which is attached to the rear end of a climbing skin passes around clip 18E and is held in place while tensioned between a pair spring-loaded cams 46. Larger versions of such cams are used, for example, to secure ropes on sailing boats.

Figure 8:
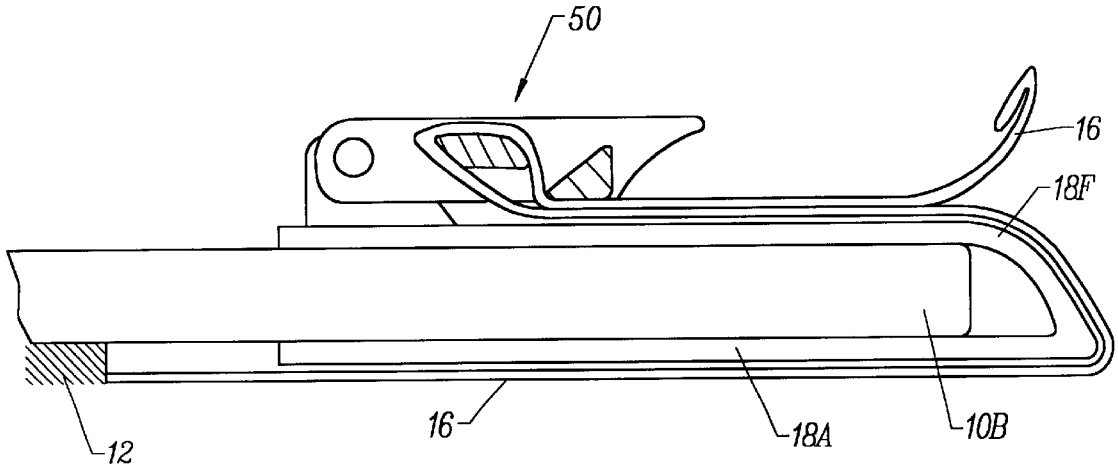
FIG. 8 is a section through a further alternative embodiment of the invention wherein a strap is held by a tension lock.

FIG. 8 shows a clip 18F according to a further alternative embodiment wherein a strap 16 is held in place by a tension lock assembly 50. Tension locks are well known and are commonly used to adjust the lengths of straps on backpacks. In a tension lock, a strap is doubled back on itself around a number of surfaces tending to resist slippage.

Figure 9:
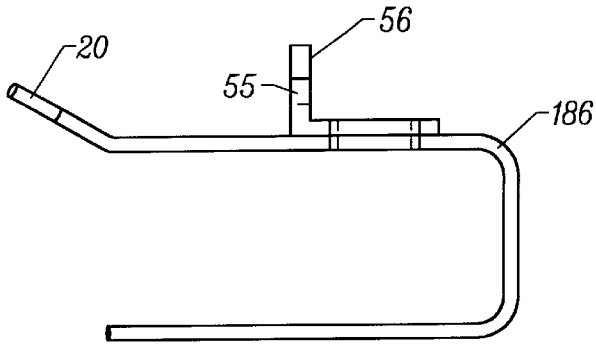
FIG. 9 is a side elevation of a clip according to an alternative embodiment of the invention wherein a strap passes through an upright flange on the clip.

As described above, in preferred embodiments the clip 18 is slidably disposed on the strap or cord which is attached to skin 12. This prevents clip 18 from becoming lost when skin 12 is detached from ski 10. The embodiment of FIGS. 1 and 2 shows the strap 16 passing through a pair slots on either side of a bend in the upper portion of clip 18. Clip 18 could be configured in any of various alternative ways which also cause clip 18 to be slidably disposed on a strap or cord when the skin is detached from a ski. For example, FIG. 9 shows a clip 18G wherein a strap or cord passes through an aperture 55 in a flange 56 which projects upwardly from a top surface of clip 18G. A strap or cord could also pass through a loop of cord or elastic attached to a clip 18.

While it is not preferred, a strap 16 could also be held to the top of clip 18 by a section of hook and loop fastener material such VELCRO™, having one part on the clip and another part on the strap. A strap or cord could also be retained on a clip 18 by a snap fastener, mechanical clamp, or the like. Where a mechanical clamp is used a user could pull a strap or cord tight and then secure the strap or cord in place by turning a screw or the like.

It will be appreciated that while the embodiments of the invention have been described in some detail, modifications and alterations thereto may be practiced without departing from the scope of the invention.

What is claimed is:

1. A retention system for retaining a climbing skin to a tail end of a ski comprising:

(a) an elongated resilient tensioning member having a plurality of longitudinally spaced apertures, secured to one end of the skin; and (b) a mounting clip separate from the ski and adapted to engage the tail end of a ski, the clip having:

(i) a base portion to underlie the tail end of the ski;

(ii) a vertical section extending from the base portion to extend behind the tail end; and (iii) an upper portion extending from the vertical section to overlie the tail end of the ski, the upper portion comprising a projection operable to engage at least one of the plurality of longitudinally spaced apertures.

2. The retention system of claim 1, wherein the projection extends toward the ski when the mounting clip is engaged on the tail end of the ski.

3. The retention system of claim 1, wherein the upper portion comprises a first part that extends from the vertical section and a second part that extends towards the ski when the mounting clip is engaged on the tail end of the ski.

4. The retention system of claim 1 wherein the mounting clip further comprises an aperture adapted to receive the tensioning member therethrough.

5. The retention system of claim 3, wherein the second part terminates in the projection adapted for engaging at least one of the plurality of longitudinally spaced apertures.

6. The retention system of claim 3, wherein the first part extends at an acute angle from the vertical section and the second part terminates in the projection adapted to engage at least one of the plurality of longitudinally spaced apertures.

7. The retention system of claim 4 wherein the aperture is within the upper portion.

8. The retention system of claim 6 wherein the mounting clip further comprises an aperture adapted to receive the tensioning member therethrough.

9. The retention system of claim 8 wherein the aperture is within the upper portion.

10. A retention system for retaining a climbing skin to a tail end of a ski comprising:

(a) an elongated resilient perforated tensioning member secured to one end of said skin; and (b) a generally C-shaped mounting clip separate from the ski and adapted to engage the tail end of the ski, the clip having:

(i) a base portion to underlie the tail end of the ski;

(ii) a vertical section extending from the base portion to extend behind the tail end of the ski; and (iii)an upper portion extending from the vertical section and terminating in a projection adapted to engage the perforated tensioning member, wherein the projection extends toward the ski when the mounting clip is engaged on the tail end of the ski.

11. The retention system of claim 10, wherein the upper portion comprises a first part that extends from the vertical section and a second part that extends towards the ski when the mounting clip is engaged on the tail end of the ski and the second part terminates in the projection adapted for engaging the perforated tensioning member.

12. The retention system of claim 10 wherein the mounting clip comprises an aperture within the upper portion to receive the tensioning member therethrough.

13. The retention system of claim 11, wherein the first part extends from the vertical section at an acute angle.

14. A kit for modifying a climbing skin for retention of the skin to the tail end of a ski, the kit comprising:

(a) an elongated resilient tensioning member having a plurality of longitudinally spaced apertures, adapted to be secured to one end of the skin; and (b) a mounting clip separate from the ski and adapted to engage the tail end of a ski, the clip having:

(i) a base portion to underlie the tail end of the ski;

(ii) a vertical section extending from the base portion to extend behind the tail end; and (iii)an upper portion extending from the vertical section to overlie the tail end of the ski, the upper portion comprising a projection operable to engage at least one of said plurality of longitudinally spaced apertures.

15. The kit of claim 14, wherein the projection extends toward the ski when the mounting clip is engage on the tail end of the ski.

16. The kit of claim 14, wherein the upper portion comprises a first part that extends from the vertical section and a second part that extends towards the ski when the mounting clip is engaged on the tail end of the ski.

17. The kit of claim 14, wherein the mounting clip further comprises an aperture adapted to receive the tensioning member therethrough.

18. The kit of claim 14, wherein the mounting clip comprises an aperture within the upper portion adapted to receive the tensioning member therethrough.

19. The kit of claim 16, wherein the second part terminates in the projection adapted for engaging at least one of the plurality of longitudinally spaced apertures.

20. The kit of claim 16, wherein the first part extends at an acute angle from the vertical section and the second part second part terminates in the projection adapted to engage at least one of the plurality of longitudinally spaced apertures.

* * * * *